US009190205B2

(12) United States Patent
Outten et al.

(10) Patent No.: US 9,190,205 B2
(45) Date of Patent: Nov. 17, 2015

(54) INTEGRAL MOLD FOR A TRANSFORMER HAVING A NON-LINEAR CORE

(71) Applicant: ABB Technology AG, Zurich (CH)

(72) Inventors: Samuel S. Outten, Washington, DC (US); Joel A. Kern, Wytheville, VA (US); Thomas A. Hartmann, Wytheville, VA (US); Charlie Sarver, Rocky Gap, VA (US)

(73) Assignee: ABB Technology AG, Zurich (CH)

( * ) Notice: Subject to any disclaimer, the term of this patent is extended or adjusted under 35 U.S.C. 154(b) by 16 days.

(21) Appl. No.: 13/661,394

(22) Filed: Oct. 26, 2012

(65) Prior Publication Data

US 2013/0106546 A1 May 2, 2013

Related U.S. Application Data

(60) Provisional application No. 61/552,521, filed on Oct. 28, 2011.

(51) Int. Cl.
*H01F 30/12* (2006.01)
*H01F 27/08* (2006.01)
(Continued)

(52) U.S. Cl.
CPC ..... *H01F 30/12* (2013.01); *H01F 27/02* (2013.01); *H01F 27/327* (2013.01); *H01F 41/0687* (2013.01); *H01F 41/127* (2013.01)

(58) Field of Classification Search
CPC ..... H01F 30/12; H01F 30/14; H01F 37/00; H01F 27/306; H01F 27/2847; H01F 27/38; H01F 27/325; H01F 30/06; H01F 38/10
USPC ..... 336/5, 15, 170, 192
See application file for complete search history.

(56) References Cited

U.S. PATENT DOCUMENTS 2,305,999 A 12/1942 Steinmayer
2,401,952 A 6/1946 Mayberry
(Continued)

FOREIGN PATENT DOCUMENTS

CN 201178018 * 1/2009
EP 2367181 A1 9/2011
(Continued)

OTHER PUBLICATIONS

M. Reder, International Searching Authority (EPO), International Search Report and Written Opinion of the International Searching Authority for International Application No. PCT/US2012/061873, European Patent Office, mailed Jan. 31, 2013.

*Primary Examiner* — Elvin G Enad
*Assistant Examiner* — Kazi Hossain
(74) *Attorney, Agent, or Firm* — Melissa J. Szczepanik

(57) ABSTRACT

A three-phase non-linear dry-type transformer has integral molds formed of a glass fiber-reinforced polymeric material. The low voltage coil is comprised of an inner low voltage mold formed around each of the at least three core legs, a low voltage conductor winding wound upon the inner low voltage mold and an outer low voltage mold formed around the low voltage winding. The high voltage coil is comprised of an inner high voltage mold disposed around the outer low voltage mold, a high voltage conductor winding wound upon the inner high voltage mold, and an outer high voltage mold formed around the high voltage conductor winding. An annular space between the inner and outer high voltage molds and the inner and outer low voltage molds is filled by an insulating polymeric material during a casting process. The molds are bonded to the coil windings by the insulating polymeric material and remain during the operation of the non-linear transformer as integral components of the non-linear transformer.

11 Claims, 6 Drawing Sheets

(51) Int. Cl.

| | |
|---|---|
| ***H01F 27/10*** | (2006.01) |
| ***H01F 27/28*** | (2006.01) |
| ***H01F 27/30*** | (2006.01) |
| ***H01F 27/02*** | (2006.01) |
| ***H01F 27/32*** | (2006.01) |
| ***H01F 41/06*** | (2006.01) |
| ***H01F 41/12*** | (2006.01) |

(56) References Cited

U.S. PATENT DOCUMENTS

| | | | | |
|---|---|---|---|---|
| 5,313,037 | A * | 5/1994 | Hansen et al. | 219/632 |
| 5,621,372 | A * | 4/1997 | Purohit | 336/60 |
| 6,221,297 | B1 | 4/2001 | Lanoue et al. | |
| 6,223,421 | B1 | 5/2001 | Lanoue et al. | |
| 6,930,579 | B2 | 8/2005 | Radford et al. | |
| 7,362,201 | B2 * | 4/2008 | Saegusa et al. | 336/90 |
| 2004/0108926 | A1 * | 6/2004 | Hopkinson et al. | 336/5 |
| 2005/0012581 | A1 * | 1/2005 | Ono et al. | 336/90 |
| 2008/0024256 | A1 * | 1/2008 | Pauley et al. | 336/92 |
| 2009/0128276 | A1 * | 5/2009 | Horowy et al. | 336/96 |
| 2011/0175696 | A1 * | 7/2011 | Hanov et al. | 336/59 |
| 2012/0126923 | A1 * | 5/2012 | Navarro et al. | 336/5 |

FOREIGN PATENT DOCUMENTS

| | | | |
|---|---|---|---|
| JP | 55141714 | A | 11/1980 |
| JP | 58202520 | A | 11/1983 |
| JP | 63192219 | A | 8/1988 |
| JP | 2008-072070 | * | 9/2006 |
| JP | 2008072070 | A | 3/2008 |
| WO | 2005027155 | A1 | 3/2005 |

* cited by examiner

INTEGRAL MOLD FOR A TRANSFORMER HAVING A NON-LINEAR CORE

FIELD OF INVENTION

The present application is directed to a transformer having a non-linear core, and more particularly, to integral molds for high voltage and low voltage coils in a transformer having a non-linear core.

BACKGROUND

Dry-type transformer coil windings are typically cast using inner and outer metal casting molds that surround the inner and outer surfaces of the transformer coil windings. The end surfaces of the casting molds may be open and therefore used to introduce an insulating material such as a polymeric or an epoxy material, depending on the casting process utilized. In a transformer having a linear core wherein the legs of the core are arranged in an "E" formation, inner and outer molds work well because the coils can be wound and cast apart from the core. The molds are then removed and the finished coils are mounted to the core legs, respectively.

However, in a dry-type transformer that has a non-linear or triangular core, the core frames that comprise the core are closed. A closed core requires that the coils are wound directly onto the core. The closed core presents difficulty in maneuvering and removing the metal molds from the newly cast coils. As metal can cause degradation of the insulating material on the coils, the molds must be removed from the coils after casting. Thus, the metal molds must often be pried off of the newly cast coils. In removing the molds from the coils, damage may occur to the coils and insulating material. Therefore, there is a need for improvement in coil casting methods for non-linear transformers.

SUMMARY

A three-phase non-linear transformer comprises a ferromagnetic core having at least three core legs arranged in a non-linear configuration and coil assemblies mounted to the at least three core legs. The coil assemblies comprise a generally cylindrical low voltage mold disposed around each of the at least three core legs, respectively, a low voltage winding wound around the inner low voltage mold, and a high voltage winding disposed around the low voltage winding. The inner low voltage mold remains in place during the operation of the non-linear transformer.

A method of manufacturing a three-phase transformer having a ferromagnetic core wherein said core has at least three core legs arranged in a non-linear configuration, the method comprising: forming a non-conductive inner low voltage mold around each of the at least three core legs, respectively, securing the inner low voltage mold, and winding a low voltage winding around the inner low voltage mold.

BRIEF DESCRIPTION OF THE DRAWINGS

In the accompanying drawings, structural embodiments are illustrated that, together with the detailed description provided below, describe exemplary embodiments of inner and outer molds for low voltage and high voltage windings in a transformer having a non-linear core. One of ordinary skill in the art will appreciate that a component may be designed as multiple components or that multiple components may be designed as a single component.

Further, in the accompanying drawings and description that follow, like parts are indicated throughout the drawings and written description with the same reference numerals, respectively. The figures are not drawn to scale and the proportions of certain parts have been exaggerated for convenience of illustration.

DETAILED DESCRIPTION

Figure 1A:
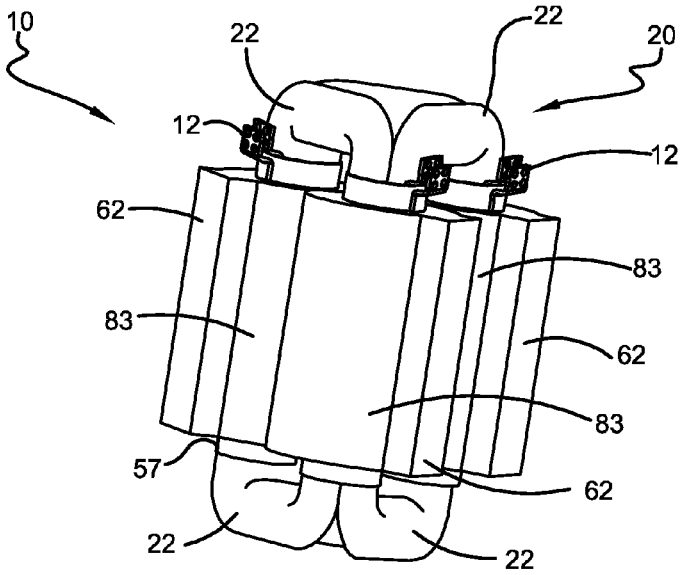
FIG. 1A is an isometric view of a three-phase non-linear dry-type transformer having an inner low voltage mold and an outer high voltage mold embodied in accordance with the present invention.
Figure 1B:
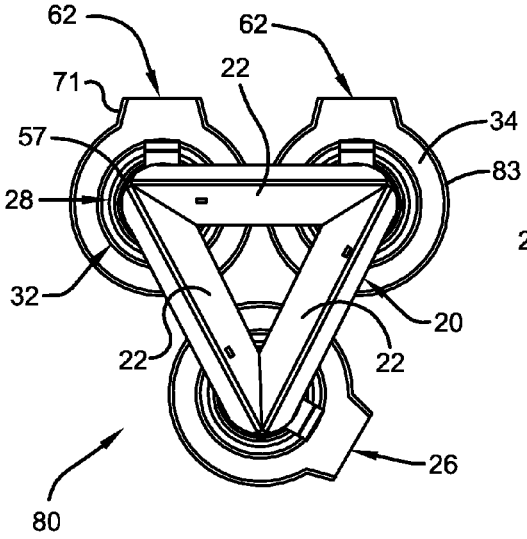
FIG. 1B is a top plan view of the non-linear transformer of FIG. 1A having an inner low voltage mold, an outer low voltage mold, an inner high voltage mold and an outer high voltage mold embodied in accordance with the present invention.

Referring to FIGS. 1A and 1B, a three-phase non-linear dry-type transformer 10 is shown having an inner low voltage mold 57, outer low voltage mold 28, inner high voltage mold 32 and outer high voltage mold 83 that are used to form coil assemblies 80. During the operation of the non-linear transformer 10, the molds 57, 28, 32, 83 remain as integral components and serve as insulation. The molds 57, 28, 32, 83 do not interfere with the electromagnetic field, and therefore, do not contribute to the erosion of insulating materials used in the coil assemblies 80.

The molds 57, 28, 32, 83 are each formed from a sheet of non-conductive material, such as a glass fiber-reinforced polymer (GFRP) resin. More specifically, the molds 57, 28, 32, 83 are formed from a continuous sheet of glass-fiber reinforced polyester resin that is from about 2 mm to about 19 mm in thickness. The molds 57, 28, 32, 83 have a generally cylindrical shape. An example of the GFRP resin sheet used to form the molds 57, 28, 32, 82 is H900 NEMA GPO-3, available from Haysite Reinforced Plastics of Erie, Pa. The H900 NEMA GPO-3 has a specification MIL I-24768/6. It should be appreciated that other non-conductive materials suitable for forming the molds 57, 28, 32, 82 may be utilized.

Figure 3A:
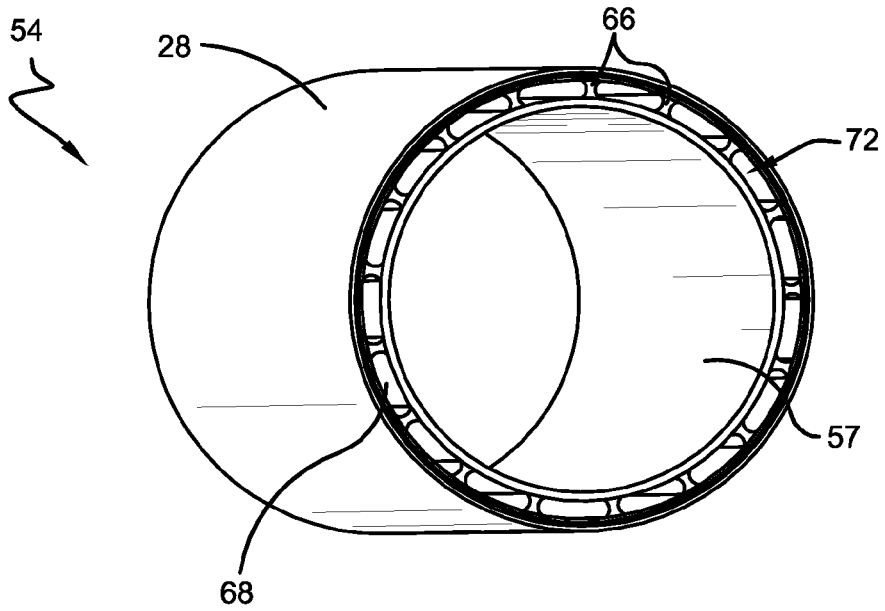
FIG. 3A is a perspective view of a low voltage coil having an inner low voltage mold and an outer low voltage mold.

Alternatively, the non-conductive material used to form the molds 57, 28, 32, 83 may be comprised of two segments of GFRP resin sheet that are connected together, as shown in FIG. 3A, at first longitudinal ends 68 of the segments. The first longitudinal ends of the mold 28, 32, 57, 83 segments are joined together using bolts, adhesive tape or an epoxy resin. The molds 28, 32, 57 may also be joined together at second longitudinal ends (not shown) using bolts, adhesive tape or epoxy resin.

Figure 1C:
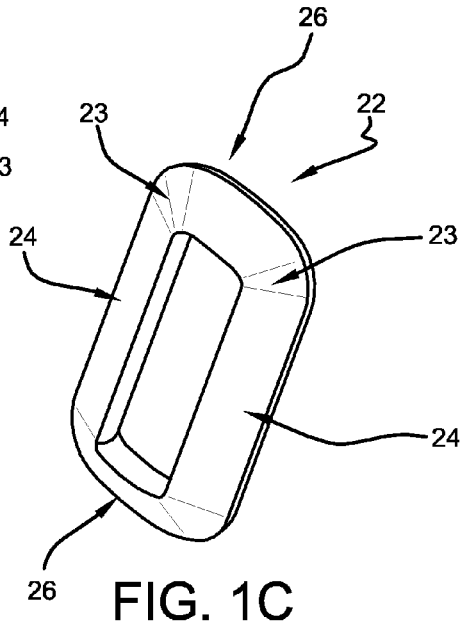
FIG. 1C is a perspective view of a frame of a core of the non-linear transformer.

With reference now to FIG. 1C, an exemplary core frame 22 of the non-linear transformer 10 is shown. At least three core frames 22 comprise the ferromagnetic core 20 of the non-linear transformer 10. Each of the at least three core frames 22 are wound from one or more strips of metal such as silicon steel and/or amorphous metal. Each of the at least three core frames 22 has a generally rounded rectangular shape and is comprised of opposing yoke sections 26 and opposing leg sections 24. The leg sections 24 are substantially longer than the yoke sections 26. The leg sections 24 are joined to the yoke sections 26 by shoulders 23.

Figure 5:
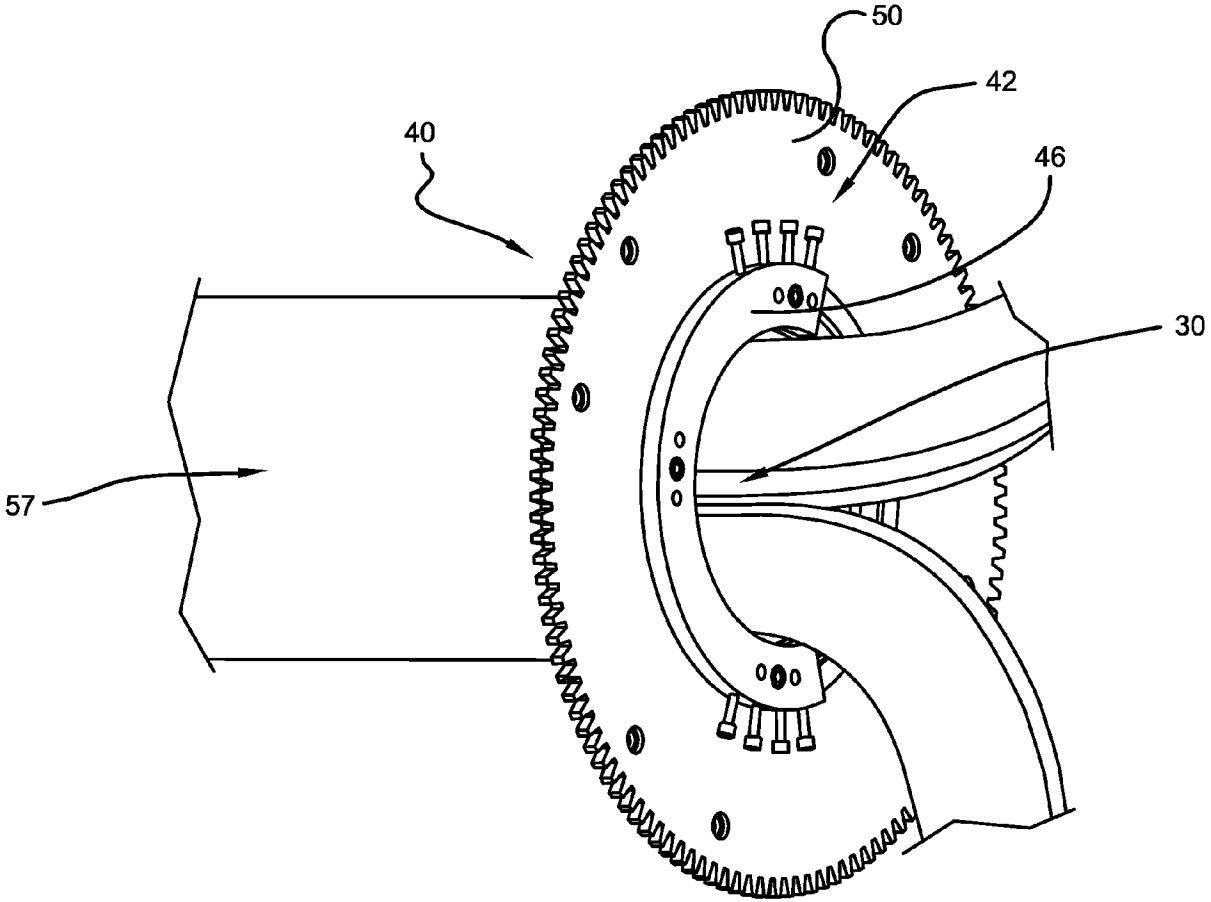
FIG. 5 shows a portion of the winding device of FIG. 2B mounted to a leg of the core.

The non-linear transformer 10 is assembled by aligning the leg sections 24 of each of the at least three core frames 22 to abut adjacent leg sections 24 of the other core frames 22. Each set of two abutting leg sections 24 forms, as shown in FIG. 5, a core leg 30. The assembled core 20 is held together using a plurality of bands of dielectric or adhesive tape that are securely disposed around the abutting leg sections 24 to secure the core frames 22 in a triangular or delta configuration. The triangular configuration is apparent when viewing the transformer from above, as depicted in FIG. 1B.

Coil assemblies 80 are mounted to the core legs 30, respectively. Each coil assembly 80 comprises a high voltage winding 34 and a low voltage winding 72 which is shown in FIG. 2B. The low voltage winding 72 is typically disposed within and radially inward from the high voltage winding 34. The high and low voltage windings 34, 72 are formed of a conductive material such as copper or aluminum. The high and low voltage windings 34, 72 are formed from one or more sheets of conductor, a wire of conductor having a generally rectangular or circular shape, or a strip of conductor.

Figure 2A:
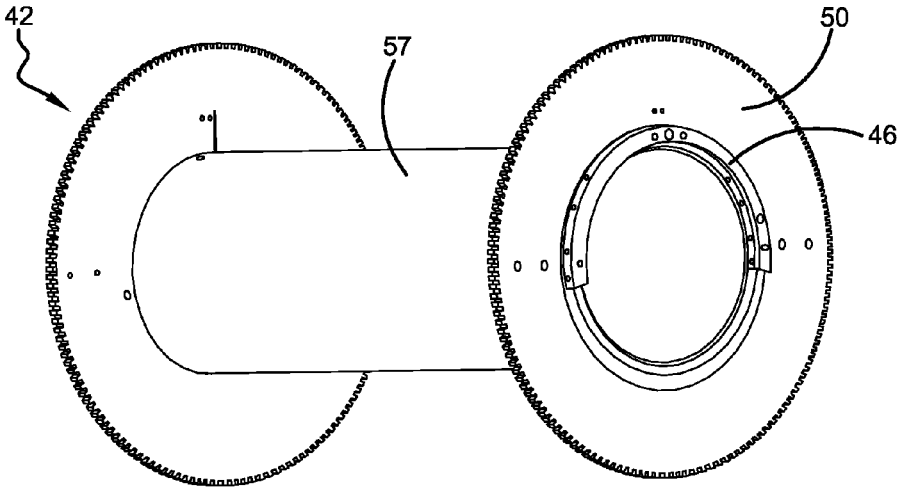
FIG. 2A is a perspective view of a winding device utilized in winding the low voltage winding, the winding device having an inner low voltage mold.
Figure 2B:
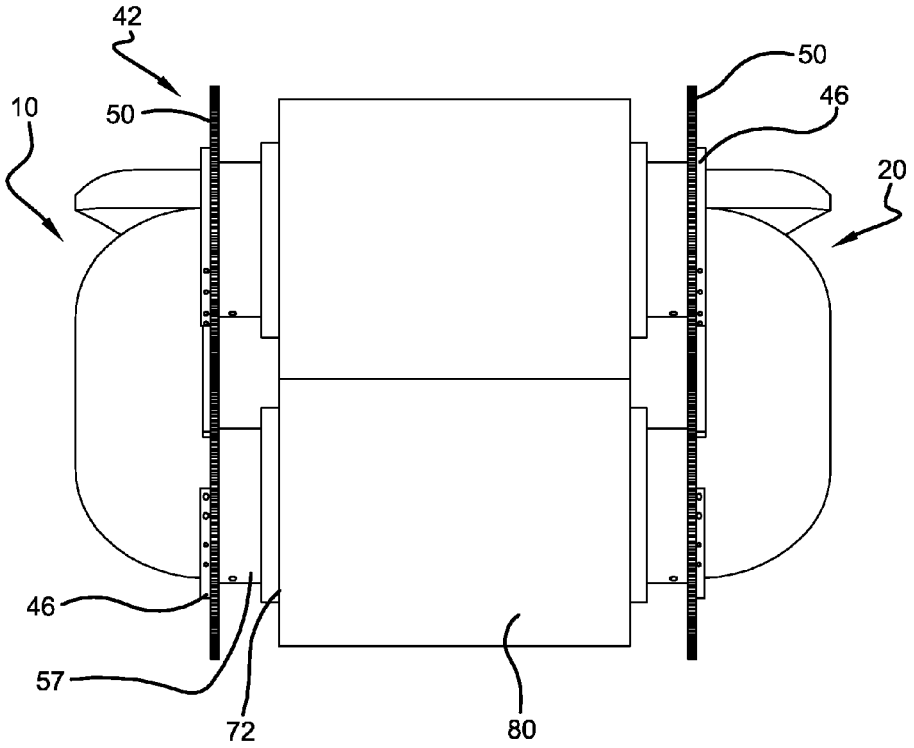
FIG. 2B is a side view of a non-linear transformer positioned horizontally and having a winding device attached to core legs, respectively.

Referring now to FIGS. 2A and 2B, an inner low voltage mold 57 extends between a pair of gear baffles 50. The inner low voltage mold 57 is supported by an annular ledge (not shown) that protrudes from an inside surface of the gear baffle 50 and is located toward the inner central opening of the gear baffle 50. The inner low voltage mold 57 in conjunction with gear baffles 50, a fixation ring 46 and an orbital ring 48 comprise a winding device 42. The winding device 42 is used to rotate the inner low voltage mold 57 and wind the low voltage conductor 72 upon the inner low voltage mold 57. As will be described in more detail below, the winding device 42 is also used to form the high voltage winding 34 around the inner high voltage mold 32.

The winding device 42 is secured to each core leg 30, through the fixation ring 46. A plurality of threaded bores are formed in the fixation ring and are adapted to threadably receive a plurality of securement screws. Referring now to FIG. 5, the fixation ring 46 is placed on a core leg 30, toward the shoulder 23, and the securement screws are threaded through the bores and into a wedging engagement with the leg 30, thereby securing the fixation ring 46 to the core 20.

The teeth of the gear baffle 50 may be engaged with a drive gear (not shown) that is driven by an electric motor or other source of rotational force. Rotation of the drive gear causes the gear baffle 50 to rotate around the track of the orbital ring 48. As the gear baffle 50 rotates, the inner low voltage mold 57 also rotates and a sheet or insulation-wrapped wire of low voltage conductor 72 is pulled from a supply of sheet or wire conductor and wound around the inner low voltage mold 57.

The inner low voltage mold 57 is formed from a continuous sheet or formed from two segments of GFRP resin (as previously described), around each of the at least three core legs 30. When the inner low voltage mold 57 is embodied as a continuous sheet, a sheet of GFRP resin of a predetermined size is wound around each core leg 30, respectively. A glass fiber tape or an adhesive tape is used to secure the inner low voltage mold 57 in place. The inner low voltage mold 57 is formed around the core leg 30 so that an outer surface of the core leg 30 and an inner surface of the inner low voltage mold 57 are separated by a radial gap of about 10 mm to about 20 mm. The gap provides clearance for the inner low voltage mold 57 to rotate with the gear baffles 50 while the core 20 is kept stationary during the winding of the conductor for the low voltage coil 54 or the high voltage coil 70. In this manner, the inner low voltage mold 57 is utilized as the mandrel upon which the conductor is wound.

Figure 3B:
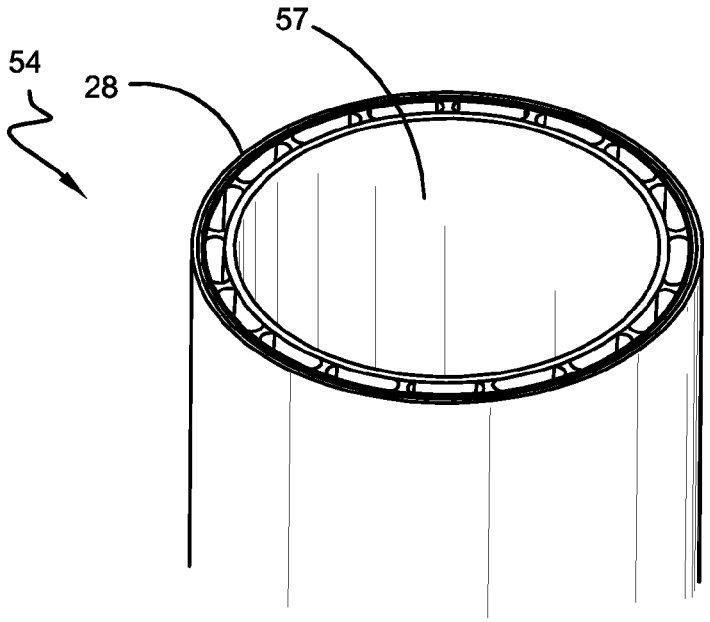
FIG. 3B is a side view of the low voltage coil of FIG. 3A.

Referring now to FIGS. 3A and 3B, the low voltage winding 72 is formed from a sheet or wire of conductive material such as copper or aluminum that is wound directly upon the inner low voltage mold 57 or upon a glass grid insulation layer surrounding the inner low voltage mold 57. As the winding device 42 causes the gear baffles 50 to rotate, the inner low voltage mold 57 rotates and the conductor sheet or wire is pulled from a supply of conductive material and wound onto the inner low voltage mold 57. Sheets of insulating material such as an aramid paper, a polyimide film or a polyester film may be dispensed from the same supply as the conductor sheeting or a different supply in alternating layers of conductor and insulation. An outer low voltage mold 28 is then formed around the low voltage winding 72 by wrapping a sheet of GFRP resin around the low voltage winding and securing the GFRP sheet with a glass fiber tape or adhesive tape.

In one embodiment, spacers 66 are inserted between successive low voltage conductor 72 layers and placed at predetermined intervals from adjacent spacers 66. In that same embodiment, the spacers 66 are rods formed from a polyester resin similar to the molds 57, 28, 32, 83. The spacers 66 may be round, dog bone-shaped, rectangular or any other shape that when used in conjunction with other axially arranged spacers 66, creates channels that allow air flow between conductive layers. The air flow in the channels cool the low voltage coil 54 when the transformer 10 is in operation. The spacers 66 may be placed between alternating layers of low voltage conductor 72 and insulating material such as an aramid paper, a polyimide film or a polyester film.

Figure 4A:
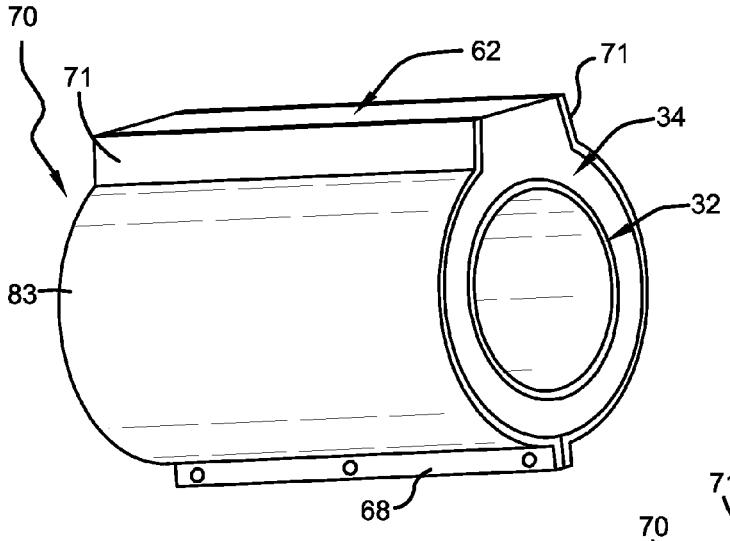
FIG. 4A is an isometric side view of a high voltage coil having an inner high voltage mold and an outer high voltage mold formed of two segments.
Figure 4B:
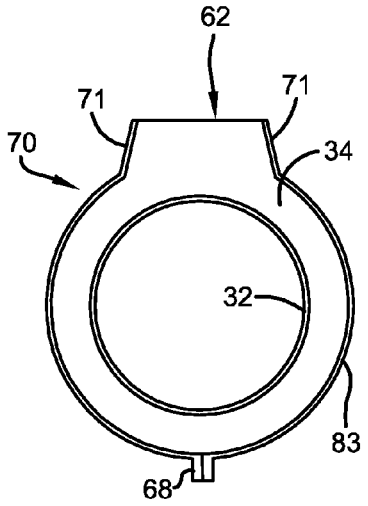
FIG. 4B is an end view of the high voltage coil of FIG. 4A.

With reference now to FIGS. 4A and 4B, an inner high voltage mold 32 is formed around the outer low voltage mold 28 by wrapping a predetermined length of a sheet of GFRP material around the outer low voltage mold 28. The sheet is secured with glass fiber tape or an adhesive tape. In one embodiment, a gap may be present between the outer low voltage mold 28 and the inner high voltage mold 32 to allow air flow between the outer low voltage mold 28 and the inner high voltage mold 32. Alternatively, a high/low barrier may be provided to electrically insulate the outer low voltage mold 28 from the inner high voltage mold 32. In one embodiment, the outer low voltage mold 28 functions additionally as the inner high voltage mold 32, eliminating the need for a separate inner high voltage mold.

A high voltage winding 72 is wound around the inner high voltage mold 32 or the outer low voltage mold 28. The high voltage winding 34 is a disc winding of a conductor strip or foil formed from a conductive material such as copper or aluminum. The conductor strip is wrapped in insulation or provided in alternating layers of conductor and insulation strip. The high voltage winding 34 may be embodied as a plurality of disc windings that are connected in series.

Figure 4C:
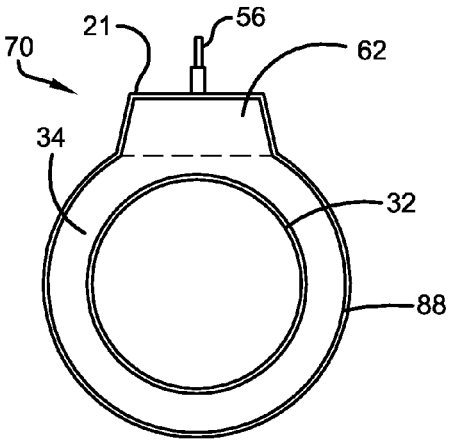
FIG. 4C is an end view of a high voltage coil having an inner high voltage mold, a partial outer high voltage mold comprised of one segment and a dome cap shown in broken lines.

An outer high voltage mold 83 having a substantially cylindrical shape is then formed around the high voltage winding 34 using a continuous sheet of GFRP resin or two segments of a predetermined length of GFRP sheet having first 68 and second longitudinal ends. The first longitudinal ends 68 are held together by bolts, an epoxy resin, or an adhesive tape. Flanges 71 are formed and extend outward from the second longitudinal ends of the outer high voltage mold 83. As shown in FIG. 4C, a dome 62, housing at least one tap 56, is located between the flanges 71. The at least one tap 56 is comprised of a connection point along the windings of a transformer, that may be used to control the turns ratio of the high voltage winding to the low voltage winding. As a result, the desired voltage, current or phase adjustments may be achieved at the output of the transformer 10. The dome 62 and the at least one tap 56 are encapsulated in the same dielectric polymeric material as the high voltage windings 34 during casting, the casting process to be discussed in detail below.

The outer high voltage mold 83 is formed around the high voltage winding 34 by positioning the sheet of GFRP resin around the high voltage winding 34 so that extra material is present for forming a flange 71 on both sides of the dome 62. A heating element such as a propane gun is used to apply heat to the surface of the glass-reinforced polyester resin sheet in order to form the flanges 71 into a trapezoidal shape with respect to the body of the high voltage coil 70, as depicted in FIG. 4A. Heat is applied to the GFRP resin sheet until the curing temperature is reached for the thermosetting GFRP material. The GFRP sheet may already contain a catalyst that initiates curing under high temperature and pressure.

The outer high voltage mold 83 is positioned so that there is an annular space between the outer high voltage mold 83 and the inner high voltage mold 32 that includes the high voltage coil winding. A resin fills the annular space including the gaps between layers or adjacent windings of conductor in the high voltage coil windings. Likewise, there is an annular space between the inner low voltage mold 57 and the outer low voltage mold 28 that includes the low voltage coil winding. A resin fills the annular space including the gaps between layers or adjacent windings of conductor in the low voltage coil windings. The annular space is from about one mm to about 40 mm in thickness, depending on the coil specifications. The thickness of the polymeric material on the cast low voltage and high voltage coils 54, 70 is therefore about the same thickness as the annular space.

With reference now to FIG. 4C, a partial outer high voltage mold 83 is shown. The partial outer high voltage mold 88 is not used to form the flanges 71 of trapezoid-shaped dome 62. Instead, a dome cap 21 is used during casting to form the flanges 71 of the dome 62. The dome cap 21 is comprised of a generally rectangular plate that has opposing side walls and opposing end walls extending downward from the edges of the plate. In one embodiment, one or both of the end walls of the dome cap 21 are not present and the partial outer high voltage mold 88 is sealed on one or both ends using the gear baffles 50 of the winding device 42. In the embodiment where only one end is sealed by a gear baffle in a vertical casting process, the open end of the coil assembly 80 is positioned upward, respectively, and is used as an entry point for the casting resin.

The dome cap 21 is shown in FIG. 4C partially in phantom to indicate that one or both of the end walls of the dome cap 21 may not be present. The top surface of the dome cap 21 has openings for the at least one tap 56 to extend at least partially through and thereby receive plugs to prevent full encapsulation of the taps during the casting process. The dome cap 21 may be formed of a sheet metal, GFRP resin, or another polymeric material. The dome cap 21 may be utilized in any casting process and is typically removed after the casting process is complete. The inside surfaces of the dome cap 21 may be coated with a mold release agent for easy removal after casting is complete. In an embodiment where the dome cap 21 is formed from GFRP resin, the dome cap 21 may remain during operation of the transformer.

After the coil assemblies 80 are formed using molds 57, 28, 32, 83, the coil assemblies 80 are cast in a vertical or horizontal casting process. Each coil assembly is encased in a casing 14 that is formed from an insulating polymeric material, which may be an epoxy and, more particularly, an aromatic epoxy or a cycloaliphatic epoxy. In one embodiment, the epoxy is a cycloaliphatic epoxy, still more particularly a hydrophobic cycloaliphatic epoxy composition. Such an epoxy composition may comprise a cycloaliphatic epoxy, a curing agent, an accelerator and filler, such as silanized quartz powder, fused silica powder, or silanized fused silica powder. In one embodiment, the epoxy composition comprises from about 50-70% filler. The curing agent may be an anhydride, such as a linear aliphatic polymeric anhydride, or a cyclic carboxylic anhydride. The accelerator may be an amine, an acidic catalyst (such as stannous octoate), an imidazole, or a quaternary ammonium hydroxide or halide.

Figure 6:
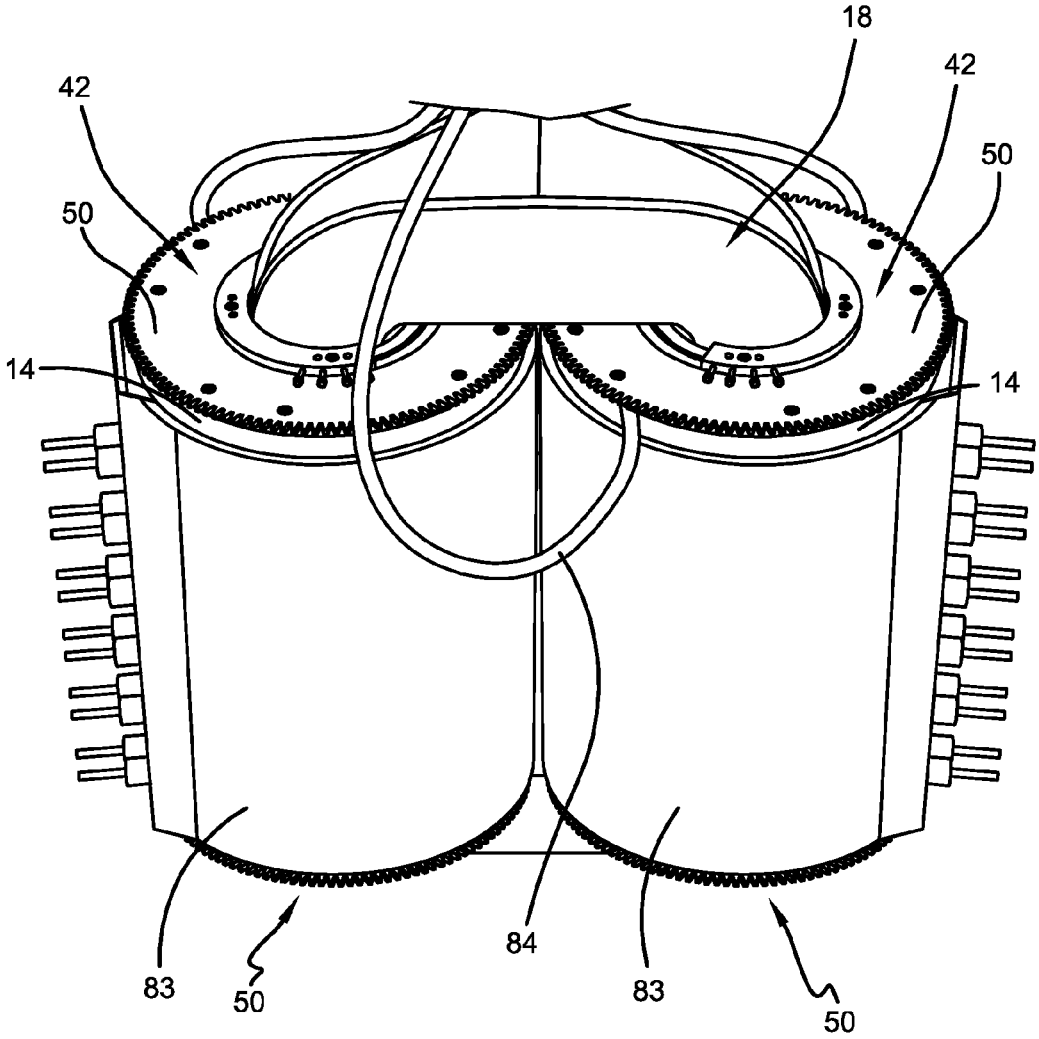
FIG. 6 shows coil assemblies of the non-linear transformer enclosed in molds and being cast in an insulating polymeric material.

In a vertical casting process as depicted in FIG. 6, the non-linear transformer 10 is positioned upright so that the coil assemblies 80 are vertical with the length of the domes positioned parallel to the core legs 30, as depicted in FIG. 6. The casing 14 for each coil assembly 80 may be formed using a casting mold formed partly by the winding device 42. More specifically, the inner low voltage mold 57 forms an inner wall of the casting mold, the outer high voltage mold 83 forms an outer wall of the casting mold, and the gear baffles 50 form ends of the casting mold, as shown in FIG. 6. The annular space located between the outer high voltage mold and the high voltage winding and between the outer low voltage mold 28 (or inner high voltage mold 32, in an embodiment wherein an outer low voltage mold 28 is not utilized) and the low voltage winding 72 is filled in by the insulating polymeric material.

During the vertical casting process, the insulating polymeric material is injected into a top portion of the casting mold via tubes 84 that extend through a gap between an upper one of the gear baffles 50 and an inside surface of the outer high voltage mold 83.

The casting process may be an automatic pressure gelation (APG) process. In accordance with the APG process, the polymeric material (in liquid form) is degassed and preheated to a temperature above 40° C., while under vacuum. The casting mold may also be heated to an elevated curing temperature of the polymeric material. The degassed and preheated polymeric material is then introduced under slight pressure into the casting mold. Inside the casting mold, the polymeric material quickly starts to gel. The polymeric material in the casting mold, however, remains in contact with pressurized polymeric material being introduced from outside the casting mold. In this manner, the shrinkage of the gelled polymeric material in the casting mold is compensated for by subsequent further addition of degassed and preheated polymeric material entering the casting mold under pressure.

The polymeric material that encapsulates the low and high voltage windings cures to a solid and permanently bonds to the molds 57, 28, 32, 83. The gear baffles 50 are disassembled and removed after the polymeric material cures. The molds 57, 28, 32, 83 remain during the operation of the transformer.

While the inner low voltage mold 57 and the outer high voltage mold 83 are basic components of the casting mold, the outer low voltage mold 28 and inner high voltage mold 32 may be provided as part of the casting mold in various combinations.

In one embodiment, the high voltage windings are encased in casings 14 and the low voltage windings are not encased in casings 14. In yet another embodiment, the low voltage windings 34 are end-filled with a polymeric material.

In a horizontal casting process, the transformer may be positioned to rest upon one core frame 26 as a base, wherein one core leg 30 (or vertice of the triangle) of the transformer 10 is positioned upward. Alternatively, the transformer 10 may be suspended horizontally using cables that are attached to the ends of the core, the cables being further attached to a crane or other supporting mechanism. The transformer may then be placed on a platform or a rack wherein the transformer is supported by a triangular clamp that connects to opposing sides of the center of the core frame 30. The coil assemblies 80 are then rotated so that the dome 62 of each coil assembly 80 is pointing upward as shown in FIG. 4A. The resin is then poured or injected into the outer high voltage mold 83 through the dome 62. If there is resin shrinkage after casting, the dome 62 area allows for the introduction of additional resin into the mold cavity.

During horizontal casting, compression rods may be positioned between the gear baffles 50 to form a tight seal between the gear baffles and the ends of the coil assembly 80. The gear baffles 50 may serve as end plates in the manner described in U.S. Pat. No. 6,223,421 to Lanoue et al., the contents of which is hereby incorporated by reference in its entirety. At the point where the ends of the coil assemblies 80 and thus, the molds 57, 28, 32, 83 meet the gear baffles 50, a rubber gasket may be installed to prevent leakage of the resin during pressurization and encapsulation of the coil in epoxy resin.

In one embodiment, dome shaping rods are secured between the gear baffles 50 and are used to form the dome 62 of the outer high voltage mold 83. The dome shaping rods are substantially thicker than the compression rods and may be left in place during the APG process. A heating element such as a propane gun may be used to form the outer high voltage mold 83 while the dome shaping rods are held between the gear baffles. The heating element is used to apply heat to the surface of the non-conductive material such as GFRP resin sheeting until the GFRP resin cures. As is well known, GFRP resin is a thermosetting material.

The molds 57, 28, 32, 83 are not limited to usage in an APG casting process of a non-linear transformer 10. Other casting processes that may utilize the molds 57, 28, 32, 83 include: open casting, vacuum pressure impregnation, and vacuum pressure encapsulation. The alternative casting processes are carried out using methods well known in the art and only modified to the extent that the casting of the coils 54, 70 occurs while the coils 54, 70 are mounted to the core of the non-linear transformer 10.

Although the non-linear transformer 10 described above has coil assemblies 80 that are cast in a resin, it should be appreciated that the present invention additionally encompasses open wound dry-type non-linear transformers 10. In an embodiment utilizing open wound transformer technology, the molds 57, 28, 32, 83 are used as a winding mandrel and provide shape to the low and high voltage coils 54, 70. In that same embodiment, following the winding of the low and high voltage coils 54, 70, the transformer 10 is subjected to a "dip and bake" cycle wherein the finished coils or the entire transformer 10 is dipped in varnish and baked using conventional methods well known in the art. In an open wound non-linear transformer, the entire transformer is typically dipped and baked.

It should be appreciated that the shape of the outer high voltage mold 83 may have a continuous circumference and thus, the high voltage coil 70 may not encompass a dome 62. In that same embodiment, the outer high voltage mold 83 is formed from a continuous sheet of non-conductive material that is connected together at the first or second longitudinal ends.

It should be appreciated that the inner low voltage mold 57, outer low voltage mold 28, inner high voltage mold 32 and outer high voltage mold 83 may be provided in any possible combination in the non-linear transformer 10. The combinations encompass the usage of all molds 57, 28, 32, 83 in the coil assemblies 80 and any combination of the molds 57, 28, 32, 83 wherein one or more of the molds 57, 28, 32, 83 are excluded from the coil assemblies 80.

It should be appreciated that both the high voltage coil 70 and the low voltage coil 54 of each coil assembly 80 may be cast in an insulating polymeric material or that only one of the high voltage coil 70 or low voltage coil 54 of each coil assembly may be cast in an insulating polymeric material.

While the present application illustrates various embodiments, and while these embodiments have been described in some detail, it is not the intention of the applicant to restrict or in any way limit the scope of the appended claims to such detail. Additional advantages and modifications will readily appear to those skilled in the art. Therefore, the invention, in its broader aspects, is not limited to the specific details, the representative embodiments, and illustrative examples shown and described. Accordingly, departures may be made from such details without departing from the spirit or scope of the applicant's general inventive concept.

What is claimed is:

1. A three-phase non-linear transformer, comprising:

a ferromagnetic core having at least three core legs arranged in a non-linear configuration;

coil assemblies mounted to said at least three core legs, respectively, each of said coil assemblies comprising:

a generally cylindrical inner low voltage mold disposed around each of said at least three core legs, respectively;

a low voltage winding wound on said inner low voltage mold;

an outer low voltage mold disposed around said low voltage winding;

a dielectric polymeric material encapsulating said low voltage winding; and a high voltage winding wound around said outer low voltage mold; said outer low voltage mold positioned so that an annular space exists between said inner and outer low voltage molds, said annular space filled by said dielectric polymeric material, said inner and outer low voltage molds remaining in place during the operation of said non-linear transformer.

2. The non-linear transformer of claim 1 further comprising an outer high voltage mold formed around an outer surface of said high voltage winding, said inner high voltage mold and said outer high voltage mold separated by an annular space.

3. The non-linear transformer of claim 2 further comprising a casing encapsulating said high voltage winding, said casing comprising a dielectric polymeric material, said dielectric polymeric material filing said annular space between said inner high voltage mold and said outer high voltage mold.

4. The non-linear transformer of claim 1 wherein said least three core legs are arranged in a triangular configuration.

5. The non-linear transformer of claim 2 wherein said inner and outer high and low voltage molds are formed of a sheet of non-conductive material.

6. The non-linear transformer of claim 5 wherein said non-conductive material is a glass fiber-reinforced polyester resin.

7. The non-linear transformer of claim 2 wherein at least one of said inner and outer high and low voltage molds is formed of two segments.

8. The non-linear transformer of claim 3 wherein said outer high voltage mold comprises first and second longitudinal ends each having a an edge surface from which a flange extends, said first and second longitudinal ends having a gap extending therebetween.

9. The non-linear transformer of claim 8 wherein said gap between said first and second longitudinal ends houses at least one tap and is filled of a dielectric polymeric material except for a top surface of said at least one tap.

10. The non-linear transformer of claim 9 wherein said dielectric polymeric material is an epoxy resin.

11. The non-linear transformer of claim 2 wherein the annular space between said high and low voltage molds is end-filled with a polymeric material.

* * * * *